US010595641B1

(12) United States Patent
Tat

(10) Patent No.: US 10,595,641 B1
(45) Date of Patent: Mar. 24, 2020

(54) PORTABLE HEAD SUPPORT FOR SLEEPING

(71) Applicant: Kim Tat, Quincy, MA (US)

(72) Inventor: Kim Tat, Quincy, MA (US)

( * ) Notice: Subject to any disclaimer, the term of this patent is extended or adjusted under 35 U.S.C. 154(b) by 0 days.

(21) Appl. No.: 16/428,972

(22) Filed: Jun. 1, 2019

Related U.S. Application Data

(63) Continuation-in-part of application No. 16/142,360, filed on Sep. 26, 2018.

(51) Int. Cl.
*A47G 9/10* (2006.01)
*A47C 16/00* (2006.01)
*A47C 7/38* (2006.01)

(52) U.S. Cl.
CPC ..... *A47C 16/00* (2013.01); *A47C 7/383* (2013.01); *A47G 9/1081* (2013.01)

(58) Field of Classification Search
CPC ..... A47C 16/00; A47C 20/00; A47C 7/38; A47C 7/383; A45C 13/30; A45F 3/02; A45F 3/14; A47G 9/1081
USPC ..... 248/118, 503, 118.5; 5/639, 652, 490; 224/257, 600, 602, 607
See application file for complete search history.

(56) References Cited

U.S. PATENT DOCUMENTS 1,639,787 A * 8/1927 Tinsley ..... A47F 5/112 248/174
2,548,547 A * 4/1951 Melrose ..... A47C 27/125 5/723
3,143,748 A * 8/1964 Manning ..... A45C 9/00 5/420
3,336,610 A * 8/1967 Geddings ..... A47D 15/00 5/420
3,879,775 A * 4/1975 Iwata ..... A47G 9/1045 5/639
4,193,152 A * 3/1980 Seibold, Jr. ..... A47G 9/0253 383/28
4,242,767 A * 1/1981 McMullen ..... A63H 33/062 297/452.16
4,607,655 A * 8/1986 Wagner ..... E04H 15/20 135/116
4,879,776 A * 11/1989 Farley ..... A47C 27/146 5/430
5,201,078 A * 4/1993 Melton ..... A41D 27/26 2/267
5,233,710 A * 8/1993 Bernard ..... A47D 5/00 5/424

(Continued)

FOREIGN PATENT DOCUMENTS

JP 2018061807 A 4/2018

OTHER PUBLICATIONS

Korean Intellectual Property Office, PCT/US2019/052335, International Search Report, dated Jan. 10, 2020.

(Continued)

*Primary Examiner* — Nkeisha Smith
(74) *Attorney, Agent, or Firm* — Richard A. Baker, Jr.

(57) ABSTRACT

An easily storable, flat neck support device for sleeping is described herein. The neck support device consists of flat, rigid panels in geometric shapes enclosed in a fabric. The fabric has fasteners. The shapes are arranged so that the folding of the fabric allows the fasteners to hold the shapes in place, forming a structure the holds a user's head in place to allow for rest or sleep, for instance when traveling on an airplane.

20 Claims, 12 Drawing Sheets

(56) References Cited

U.S. PATENT DOCUMENTS 5,265,292 A * 11/1993 Underell ..... A47C 4/52 297/380
5,305,754 A 4/1994 Honeywell
5,352,189 A * 10/1994 Schumann ..... A61F 5/0111 602/23
5,360,258 A * 11/1994 Alivizatos ..... A47D 13/107 297/184.13
5,678,800 A * 10/1997 Markussen ..... G06F 3/0395 248/118
5,826,848 A * 10/1998 Cekosh ..... A47B 96/061 248/345.1
6,009,577 A 1/2000 Day
6,158,813 A 12/2000 Karash
6,532,611 B1 3/2003 Day
6,625,829 B2 9/2003 Zell
7,004,545 B2 2/2006 Miller
7,578,014 B1 8/2009 Rodriguez
8,239,987 B2 8/2012 Sharp
8,464,375 B1 * 6/2013 Jorgensen ..... A61G 13/122 5/490
D685,161 S 7/2013 Sun
D695,996 S 12/2013 Paul
8,708,416 B2 4/2014 Stronconi
9,101,223 B2 8/2015 Walker
9,186,003 B2 11/2015 Hsu
D746,080 S 12/2015 Mittelstadt
9,247,830 B2 2/2016 Waters et al.
9,451,835 B2 9/2016 Waters et al.
9,498,056 B1 11/2016 Mills et al.
D778,086 S 2/2017 O'Meara et al.
9,572,718 B2 2/2017 Sternlight
9,578,941 B2 * 2/2017 MacLachlan ..... F16M 11/38
9,615,682 B1 4/2017 Maddocks et al.
9,629,468 B1 4/2017 McCabe et al.
9,671,057 B2 * 6/2017 Lin ..... F16M 11/38
D790,880 S 7/2017 Wong et al.
9,737,158 B2 8/2017 Kreppein
9,808,100 B2 11/2017 Jensen
9,833,025 B2 12/2017 Knapp
9,854,857 B2 1/2018 Kuusela
9,872,577 B2 1/2018 Waters et al.
9,888,793 B2 2/2018 Walker
9,924,802 B2 3/2018 Mills et al.
9,943,180 B2 4/2018 Hus
9,962,021 B2 4/2018 Kreppein
9,968,198 B2 * 5/2018 Hauer ..... A47C 7/383
D823,026 S 7/2018 Shi
10,021,949 B2 7/2018 Cooper
10,022,001 B1 * 7/2018 Hawkins ..... A47G 9/1027
2003/0226207 A1 12/2003 Lowenthal
2005/0072893 A1 * 4/2005 Brown ..... A47B 23/002 248/444
2007/0252049 A1 * 11/2007 Woodward ..... A47C 16/00 248/118
2009/0302659 A1 * 12/2009 Goddu ..... A47C 16/00 297/391
2011/0198453 A1 * 8/2011 Volk ..... A46B 17/02 248/111
2013/0047342 A1 2/2013 Schwingendorf et al.
2013/0125312 A1 5/2013 Harooni
2015/0071978 A1 * 3/2015 Chang ..... A61N 2/06 424/402
2015/0238018 A1 * 8/2015 Backer ..... A47C 7/46 5/640
2016/0081500 A1 3/2016 Bradshaw
2016/0377220 A1 * 12/2016 Lin ..... F16M 11/38 248/176.3

OTHER PUBLICATIONS

Korean Intellectual Property Office, PCT/US2019/052335, Written Opinion of the International Search Report, dated Jan. 10, 2020.

* cited by examiner

Fold 1

Fold 2

Fold 3

Fold 4

Fold 5

Fold 6

Fold 7

PORTABLE HEAD SUPPORT FOR SLEEPING

RELATED APPLICATIONS

This patent application is a continuation-in-part patent application of U.S. patent application Ser. No. 16/142,360, "Portable Head Support for Sleeping", filed on Sep. 26, 2018 by inventor Kim Tat. The disclosures of this patent application are incorporated herein by reference.

BACKGROUND

Technical Field

The system, apparatuses and methods described herein generally relate to a head support system and, in particular, to portable head support for sleeping when traveling.

Description of the Related Art

For centuries travelers have been seeking devices to help sleep when traveling. Long distance travel requires long times sitting and waiting to arrive at the destination. This is a particularly acute issue when traveling on red-eye, overnight airplane flights.

Various designs for portable pillows have been proposed. Some have designed Orthopedic pillows correct body positioning for sleepers. The pillow sets the placement and orientation of particular body parts in safe and healthy resting positions. There are particular challenges for body positioning when a sleeper is in the sitting position, such as when a passenger is seated on an airplane flight. The room is limited, and mobility is restricted. An ideal body position for sleeping is not always possible in an airplane seat. Difficult seated positions for sleeping can also be found in other situations, such as riding in trains and long distance rides in cars.

A number of devices have been developed to facilitate sleeping in the seated position. A neck pillow is a common option for travelers. The U-shaped pillow is placed on the back of the neck of the user so that the head is prevented from falling side to side and back and forward. The neck pillow fits on the user so that the height is always correct and set by the neck of the user. But the neck pillow is bulky, not particularly portable and difficult to store.

Several patents and publications are available for review in the field of sleeping devices, when the body is in the seated position. U.S. Patent Publication No. 20130047342, published for Schwingendorf et al, on Feb. 28, 2013, discloses a neck pillow with a bone structure support. U.S. Patent Publication No. 20130125312, published for Harooni, on May 23, 2013, describes a new pillow with a hood. The hood suspends the pillow around the neck to accommodate a sleeper. U.S. Design Pat. No. D695996, issued on Dec. 24, 2013 to Paul, shows a travel pillow with a scarf attachment to maintain position of the neck pillow on the user.

The prior art devices fail to stabilize the head of the sleeper on the seat. The devices do not consistently hold the position of the head to the seat back or top of the seat. Additionally, the devices are not adjustable for sleepers of different sizes and heights. Furthermore, the devices are not portable. There is a long felt need in the industry for a comfortable head support that can be easily placed in a laptop bag for transport.

BRIEF SUMMARY OF THE INVENTION

An apparatus for supporting a head of a user is described herein. The apparatus is made up of a two pieces of fabric with several flat, rigid geometric shapes, each with cushion material on one side, arranged between the fabric pieces. At least a portion of the fabric contains loop material for a hook and loop type attachment. An adhesive connects the first fabric and the second fabric at the edges of the first and second fabric and in between the geometric shapes, such that the first and second fabric holds the geometric shapes and the cushions in place. There are a plurality of tabs with hook material attached to one or more of the geometric shapes. The arrangement of the geometric shapes is such that when the first and second fabric is folded the hook and loop material hold the geometric shapes into a hollow three dimensional structure rigid structure.

This apparatus could be viewed as four layers, a first layer of fabric, wherein at least a portion of the first fabric contains loop material; a second layer of rigid foam/material lays on top of the first layer of fabric; a third layer of softer cushion material lays on the second layer of rigid foam; and a fourth layer of soft fabric lays on top of the third layer of soft cushion material, with adhesive connecting all 4 layers together. Geometric shapes are then pressed down on to all 4 layers by way of a single mold, with a plurality of tabs with hook material attached to one or more of the geometric shapes; wherein the arrangements of the geometric shapes is such that when the first and second fabric are folded to the hook and loop material to hold the geometric shapes into a hollow three dimensional rigid structure.

In some embodiments, there are four geometric pieces. In some cases the adhesive could be heat welds or chemical adhesive or thread sewn between the first and second fabric. In some embodiments the fabric is brushed nylon or polyester and in other embodiments it is felt or velveteen. The geometric shapes could be made of ethylene-vinyl acetate material. The geometric shapes could be molded in or heat pressed between the fabric and the cushion layers. The cushion shapes could be made of polyurethane foam. The fabric could be coated, fully or partially, with a non-slip material.

A method of creating a support for a head of a user is also described. The method comprises the steps of (1) folding a flat structure with a plurality of geometric shapes and cushion material adhered between two pieces of fabric with a first fold such that a first tab and a second tab are folded in front of a first geometric shape; (2) folding the flat structure with a second and third fold, moving the first and a second geometric shapes in front the flat structure, such that the second tab is attached to a third geometric shape; and (3) folding the flat structure with a fourth fold such that the first tab is in attached to a fourth geometric shape.

The first geometric shape could be a polygon. The second geometric shape could be a triangle. The third geometric shape could be a polygon. The fourth geometric shape could be a triangle. The step of adhering the second tab to the third geometric shape could be (but is not limited to) a hook and loop mechanism. The step of adhering the first tab to the fourth geometric shape could be with a hook and loop mechanism. The cushion material could be polyurethane form. The fabric could coated with a non-slip material such as a silicon coating.

DETAILED DESCRIPTION

The present inventions describe several designs for a foldable neck rest 100, 1200 for supporting the head of a traveler, whether the traveler is attempting to sleep in an airplane, train, boat, or automobile. The neck rest 100, 1200 is stored flat or folded twice for transport, and then folded into shape when the user desires sleep. The neck rest is made of rigid material with a number of flexible areas for folding. The neck rest also has several fasteners for holding the folded pieces together.

Figure 1:
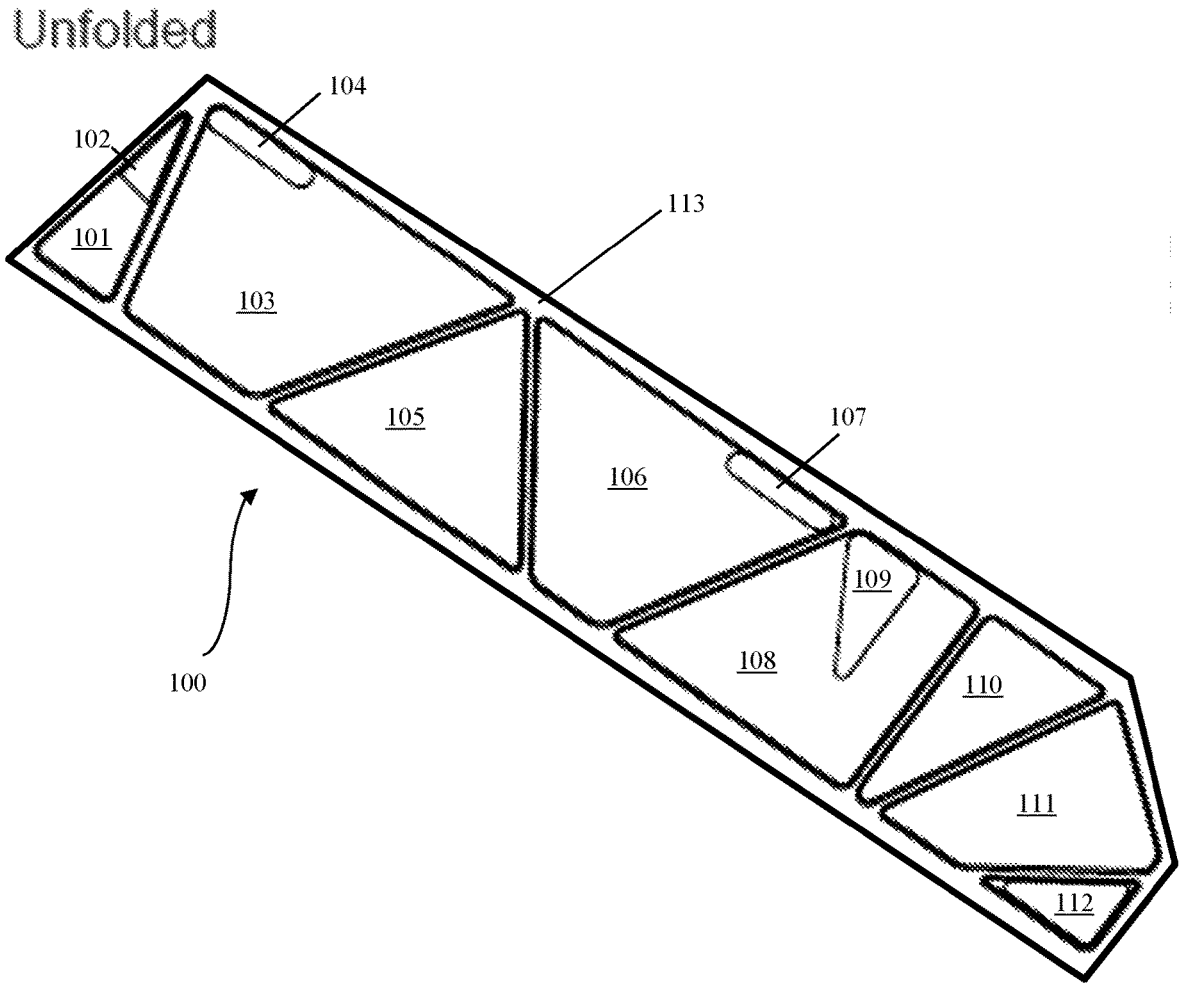
FIG. 1 shows the neck rest of the first embodiment in its unfolded state, with each of the sections and with the visible attachments.

In the first embodiment, FIG. 1 shows the neck rest 100 in a flat position. The neck rest 100 is made of a rigid material such as hard plastic, cardboard, polyethylene, heavy fabric, fiberglass, wood, Medium-density fiberboard (MDF), metal, glass, Ethylene-vinyl acetate (EVA), polyethylene-vinyl acetate (PEVA), nylon filled plastic, Styrofoam, rubber, silicon, Thermoplastic Polyolefins (TPE-O or TPO), beans, Styrofoam balls, or similar materials. In some embodiments, the rigid material is divided into 8 sections. While in some embodiments, all of the rigid materials are the same material, in other embodiments, the rigid materials could be different in different sections.

All of the sections are enclosed in between two pieces of a fabric material 101 such as felt, brushed polyester, cotton, nylon, viscose, polyester nylon blend, rayon, wool, terrycloth, or similar materials. In another embodiment, the sections could be enclosed in single piece of fabric folded in half. The two pieces of fabric material 101 could be connected by sewing, staples, adhesive, heat welding, sonic welding, or similar techniques. The fabric material extends beyond the geometric shapes by approximately 0.5 cm in each direction. The extended fabric is used for adhering the two pieces of fabric together. The thickness of the fabric and rigid material can vary, but in one embodiment is approximately 0.4 cm. In another embodiment, the fabric material is created around the geometric shapes using a thermoform process that creates a 3-D shape and structure. In still a further embodiment, a 3-D printer with multiple heads is used to create the geometric shapes of a ridged material inside of a more flexible material.

Figure 10:
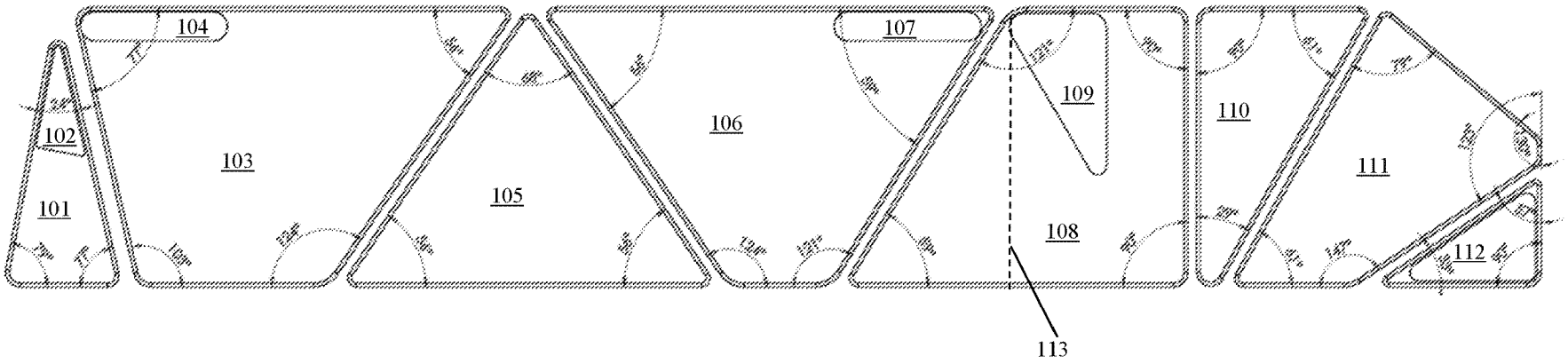
FIG. 10 shows the shapes and the angles of the neck rest in the first embodiment.

FIG. 10 shows the shapes and the angles of the neck rest 100. Without detracting from the invention, the angles in this drawing have a tolerance of ±10 degrees. In the descriptions below, the hook and loop patches could be swapped without detracting from the invention. FIG. 1 and FIG. 10 are described together.

The neck rest 100 is 11 cm by 52.5 cm in size in one embodiment, but the dimensions can be proportionally changed without detracting from the inventions described herein. It is envisioned that there will be different sizes for different people.

The neck rest 100, at one side, has a scalene triangle shape 101 of rigid material. This scalene triangle 101 has an angle of 79 degrees at the outer corner, 77 degree at the inner corner, and 24 degrees at the far end. Given the tolerances, this triangle could be an isosceles triangle in some embodiments. The width of the triangle is approximately 9 cm and the length is about 3.75 cm.

The scalene triangle 101 has a triangular patch 102 of hook material from a hook and loop material (for instance Velcro). This triangular patch 102 is a right triangle 2 cm along the bottom and 4.5 cm wide. It is located at the top of the scalene triangle 101. In one embodiment, it is adhered to the fabric with an adhesive. There are two triangular patches 102 of hook material, one on each side of the neck rest 100 in approximately the same location.

Next to the scalene triangle 101 trapezoidal shape 103 of rigid material. The first trapezoid 103 has a short length of 6 cm and a long length of 14.5 cm. The angles are 103 degrees along the short length by the scalene triangle 101 and 124 degrees at the other side. The long length has a 77 degree angle by the scalene triangle 101 and a 56 degree angle on the opposite end. The width of the first trapezoid is about 10 cm.

The first trapezoid 103 has a 5 cm by 1 cm patch 104 of hook material from a hook and loop material (for instance Velcro) along the top edge of the fabric starting at the corner along the long edge of the first trapezoid 103 near the peak of the scalene triangle 101. There are two patches 104 on the neck rest 100, one on each side of the first trapezoid 103. In one embodiment, when the neck rest 100 is laid flat, the patch 104 is close to, but does not meet, the triangle patch 102. When folded, the two patches 102, 104 may be in contact.

Adjacent to the first trapezoid 103 is an isosceles triangle 105 of rigid material with two 56 degree angles on the bottom and a 68 degree angle on the top. Given the tolerances, this could be an equilateral triangle. The isosceles triangle 105 has a width of 9.5 cm and a base of 13 cm. In some embodiments, the isosceles triangle 105 is covered with a tactile material to increase friction of the triangle on a user's shoulder, so that the head rest 100 does not slip from position when in use.

Next to the isosceles triangle 105 is a second trapezoid 106 of rigid material. This second trapezoid 106 has a short base of about 3 cm and a long top of about 15 cm. The second trapezoid is about 10 cm wide. The short base has an angle of 124 degrees on the side by the isosceles triangle 105 and an angle of 121 degrees on the other side. The long top has an angle of 56 degrees on the side by the triangle 105 and 59 degrees on the other side.

The second trapezoid 106 has a 5 cm by 1 cm patch 107 of loop material from a hook and loop material (for instance Velcro) along the top edge of the fabric starting at the corner along the long edge of the second trapezoid 106 opposite the peak of the isosceles triangle 105. There are two patches 107 on the neck rest 100, one on each side of the second trapezoid 106.

Adjacent to the second trapezoid 106 is a third trapezoid 108 of rigid material. This trapezoid 108 has a long base, perhaps 11.5 cm and a shorter top 6 cm in length. The third trapezoid 108 is about 10 cm in width. This trapezoid has a 59 degree angle at the long base by the second trapezoid 106 and a 90 degree angle at the other side of the long base. The short top has a 121 degree angle at the side near the second trapezoid 108 and a 90 degree angle at the other corner. There is also a fold or break in the rigid material delineated by the dashed line 113. This break 113 does not have a seam in the fabric, and the fabric holds both portions of the rigid material closely together. The break occurs at the top corner of the trapezoid 108 and continues to the long base at 5.5 cm from the second trapezoid 106. This creates a 5.5 cm by 10 cm right triangle and a 6 cm by 10 cm rectangle within the area of the third trapezoid 108.

The third trapezoid 108 has a 6 cm by 4 cm right triangle patch 109 of loop material from a hook and loop material (for instance Velcro) along the top edge of the trapezoid 108 starting at the corner where the internal rectangle and triangle meet. There are two patches 109 on the neck rest 100, one on each side of the third trapezoid 108.

Next to the third trapezoid 108 is a right triangle 110 of rigid material. The right triangle 110 has a 6 cm top and a 10 cm width. The angle at the bottom is 29 degrees and at the top right the angle is 61 degrees.

Next to the right triangle 110 is a trapezium 111. The trapezium 111 has a base about 4 cm in length. On the side of the right triangle 110, the angle is 61 degrees at the base. At the opposite corner, the angle is 147 degrees. From that corner, the side runs 8.5 cm to a corner. This corner has a 73 degree angle to a top side, the top side has a length of about 7.5 cm to a 79 degree corner. The final side has an 11 cm side.

Adjacent to the trapezium 111 is a second right triangle 112. This second right triangle 112 has sides of 6 cm by 5 cm. The angle closest to the trapezium 111 is 33 degrees and the remote angle is 57 degrees.

The second right triangle 112 has a 4.5 cm by 4.5 cm right triangle patch of hook material from a hook and loop material (for instance Velcro) covering most of the second right triangle 112. There are two patches on the neck rest 100, one on each side of the second right triangle 112.

FIG. 2 through FIG. 8 show the folding of the flat neck rest 100 into shape for supporting the head. Note that the order of the folding is not important, and that the neck rest 100 could be formed by folding numerous different orders.

Figure 2:
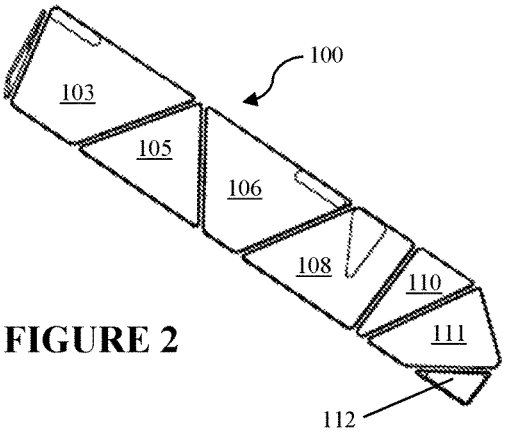
FIG. 2 shows the neck rest of the first embodiment after the first fold.

FIG. 2 shows the first fold, moving the scalene triangle panel 101 backwards at the fold between the scalene triangle 101 and the first polygon 103.

Figure 3:
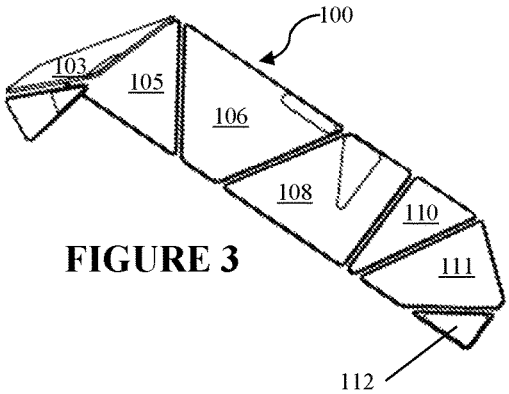
FIG. 3 shows the neck rest of the first embodiment after the second fold.

FIG. 3 shows the second fold, moving the first polygon 103 backwards at the fold between the first polygon 103 and the isosceles triangle 105.

Figure 4:
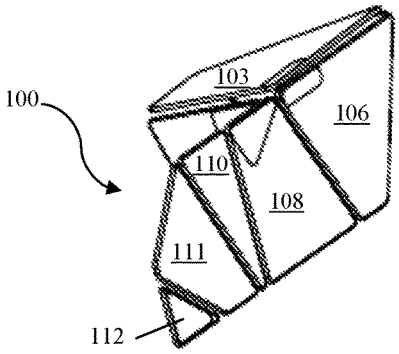
FIG. 4 shows the neck rest of the first embodiment after the third fold.

FIG. 4 shows the third fold, moving the isosceles triangle 105 backwards at the fold between the isosceles triangle 105 and the second polygon 106. The hook patch 104 from the first polygon 103 meets and adheres to the loop patch 107 on the second polygon 106. In some embodiments, this adhesion is not complete but only along the top edge.

Figure 5:
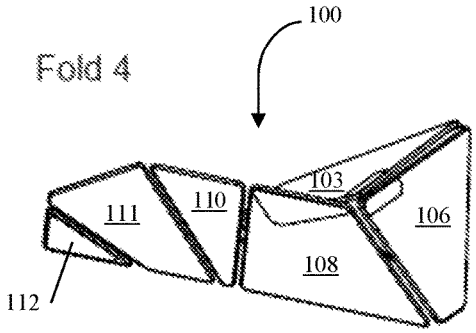
FIG. 5 shows the neck rest of the first embodiment after the forth fold.

FIG. 5 shows the fourth fold, moving the second polygon 106 backwards at the fold between the second polygon 106 and the third polygon 108. The hook patch 102 from the scalene triangle 101 meets and adheres to the loop patch 109 on the back side of third polygon 108.

Figure 6:
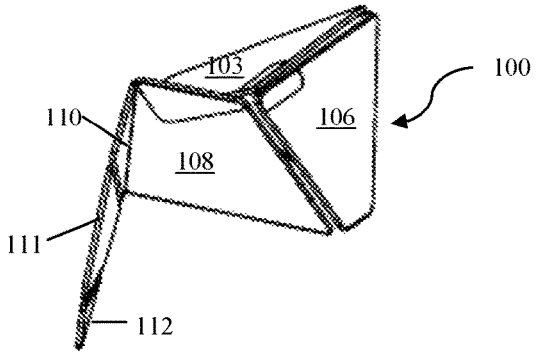
FIG. 6 shows the neck rest of the first embodiment after the fifth fold.

FIG. 6 shows the fifth fold, moving the right triangle 110 forward at the fold between the third polygon 108 and the right triangle 110.

Figure 7:
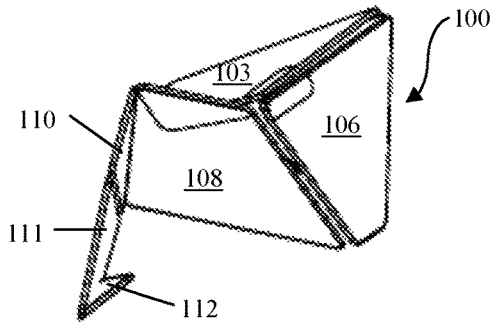
FIG. 7 shows the neck rest of the first embodiment after the sixth fold.

FIG. 7 shows the sixth fold, moving the second right triangle 112 forward at the fold between the trapezium 111 and the second right triangle 112.

Figure 8:
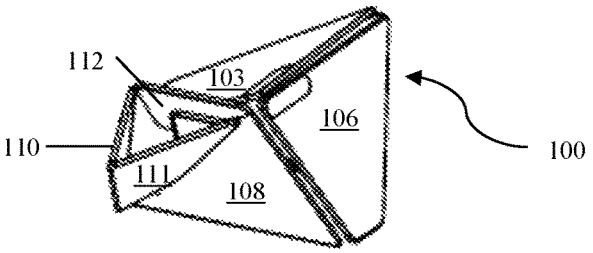
FIG. 8 shows the neck rest of the first embodiment after the seventh fold.

FIG. 8 shows the seventh fold, moving the trapezium 111 and the second right triangle 112 forward at the fold between the right triangle 110 and the trapezium 111. The hook patch covering the second right triangle 110 meets and adheres to the loop patch 109 on the front side of the third polygon 108.

Figure 9:
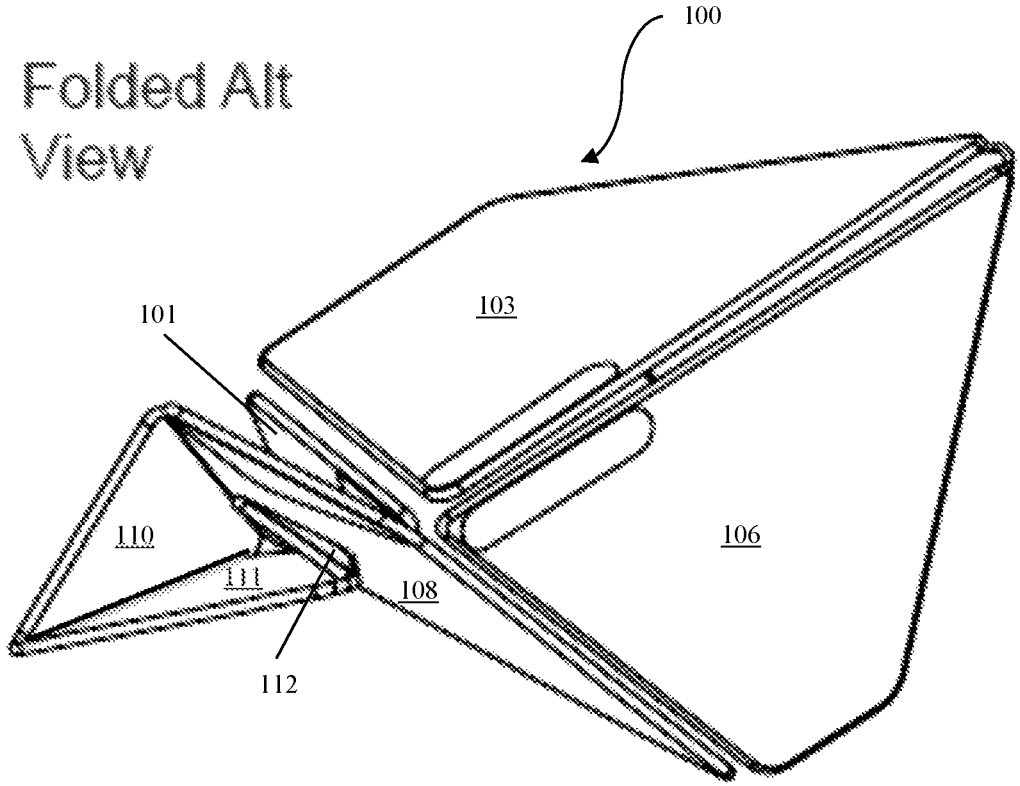
FIG. 9 shows the folded neck rest of the first embodiment for use.

FIG. 9 shows the folded neck rest 100. The isosceles triangle 106 is placed on the shoulder 1102 of the user. The users head 1101 rests against the third polygon 108 and the trapezium 111, with the user's ear against the trapezium 111 and the chin against the base of the third polygon 108. In some embodiments the surface of the isosceles triangle 106 contains a material to prevent or impede the isosceles triangle 106 from slipping on the shoulder of the user.

Figure 11:
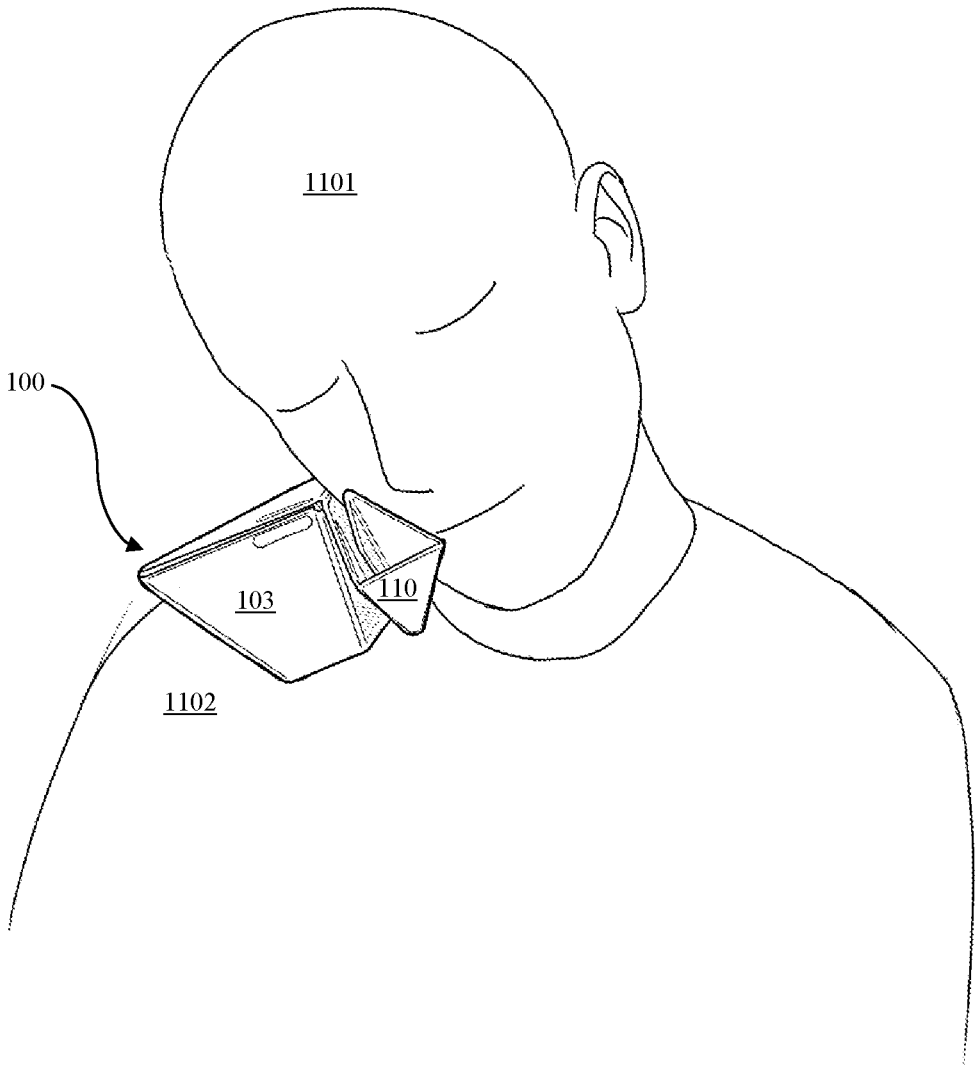
FIG. 11 shows the neck rest in use on a person.

FIG. 11 shows a person using the neck rest 100. The neck rest 100 is placed on the shoulder 1102 with isosceles triangle 105 resting on the shoulder 1102. The head 1101 rests against the third polygon 108 and the trapezium 111. First polygon 103 and right triangle 110 are facing forward.

The folding pattern described above is for the right side sleep support, if you turn the headrest over on the long side and follow folding instructions above, the neck rest 100*t* shall accommodate the left side for sleep support.

When unfolded in its flat state, the neck rest 101 can be folded into a 26 cm by 16 cm by 1 cm thick shape for easy storage in a folio or a laptop bag. The isosceles triangle 105 is moved backwards at the fold between the isosceles triangle 105 and the second polygon 106 until the isosceles triangle 105 flat against the second polygon 106. Next, the third polygon 108 is pushed backwards at the fold between the third polygon 108 and the second polygon 106 until the third polygon 108 flat against the isosceles triangle 105.

Figure 12:
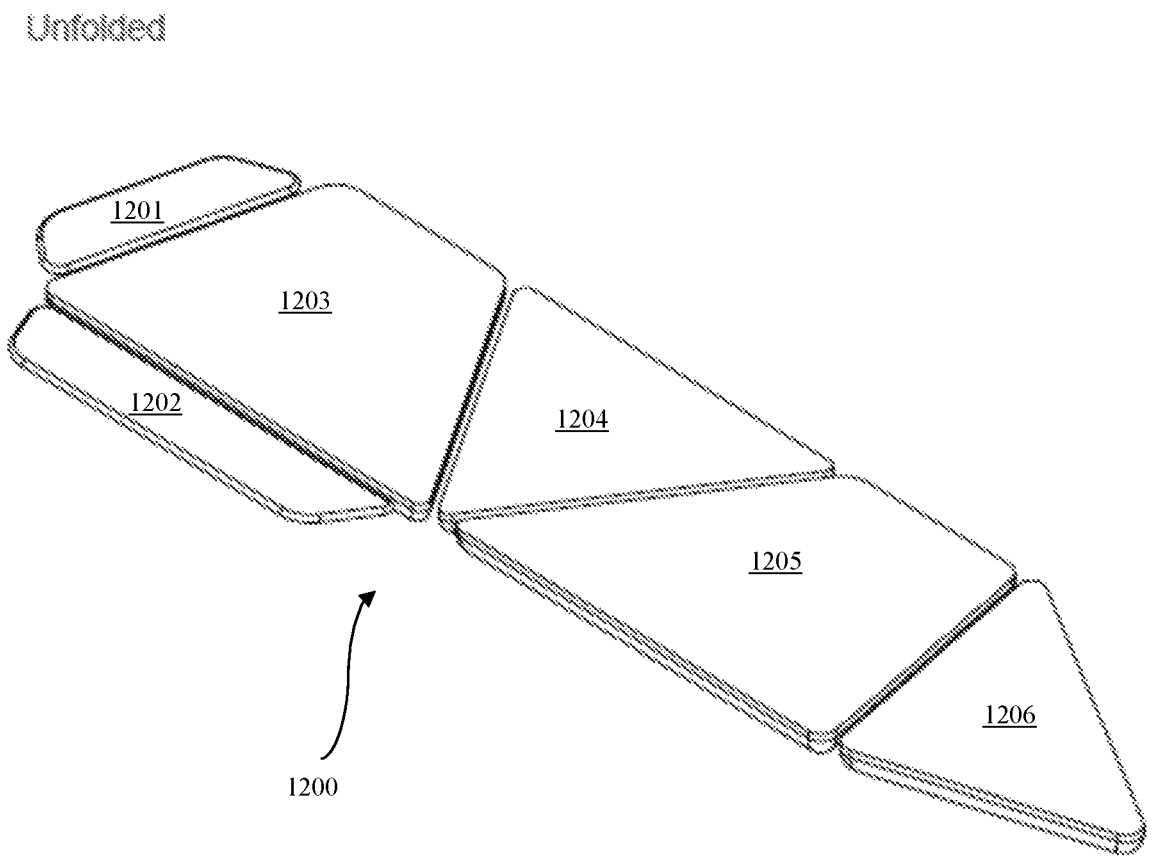
FIG. 12 shows the neck rest of the second embodiment in its unfolded state, with each of the sections and with the visible attachments.
Figure 18:
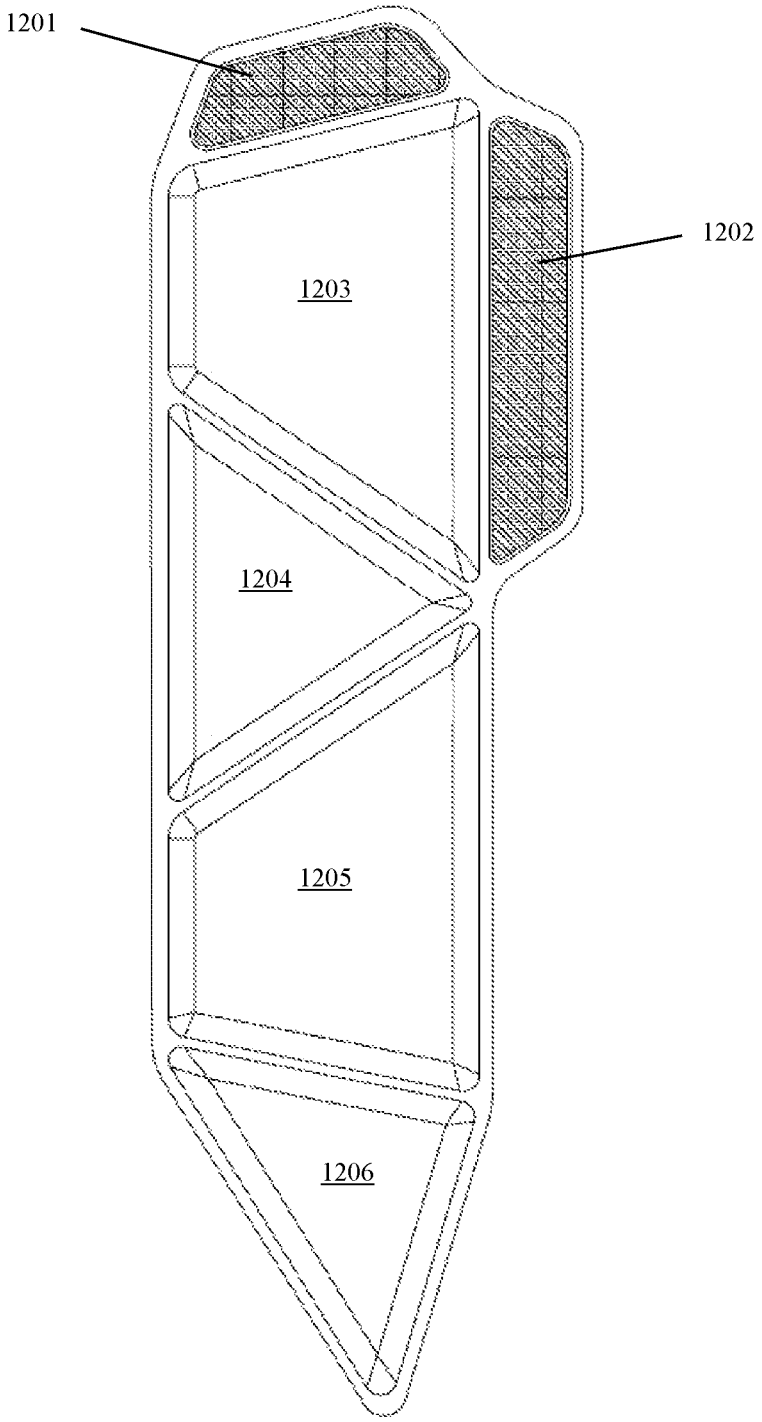
FIG. 18 shows the neck rest of the second embodiment in its unfolded state, with each of the sections and with the visible attachments, including the fabric.
Figure 19:
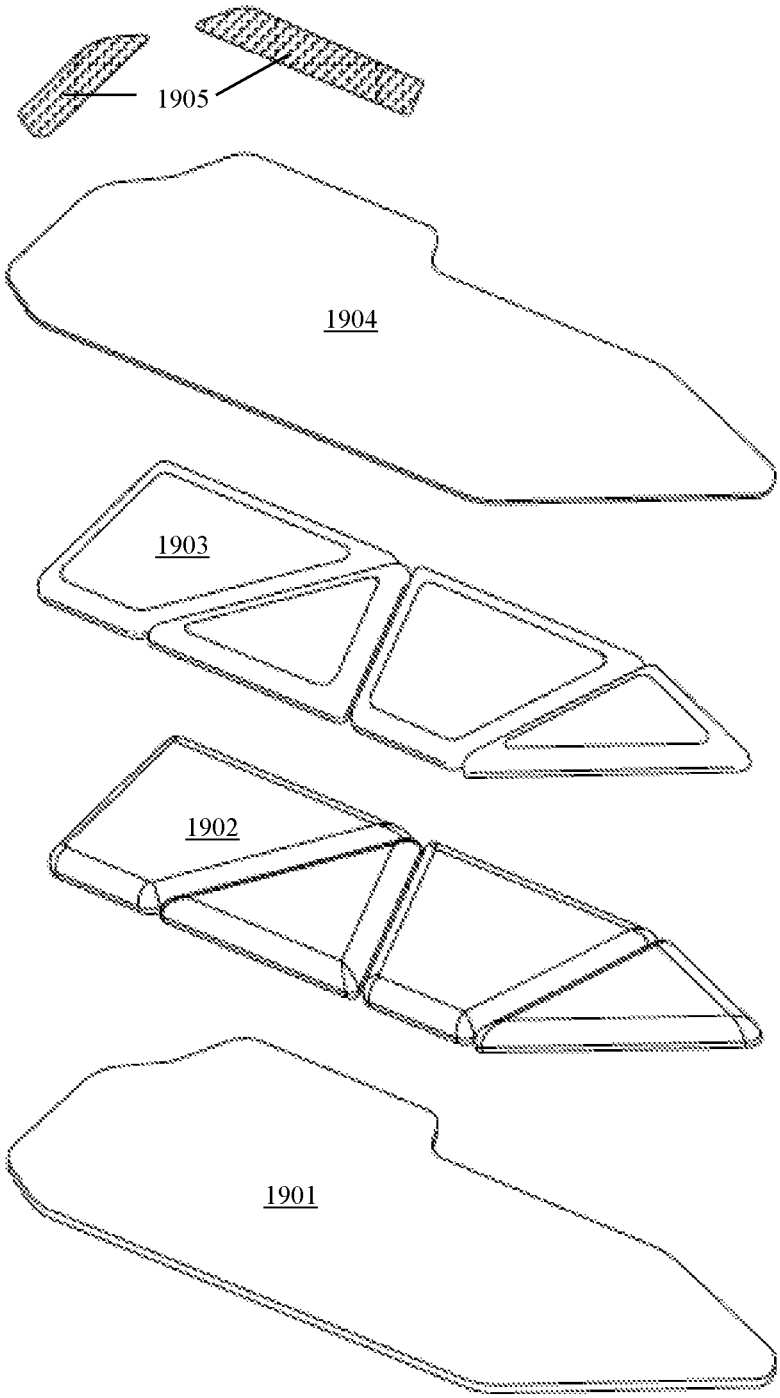
FIG. 19 shows an exploded view of the layers of each section of the neck rest.

In the second embodiment, FIG. 12 shows the neck rest 1200 in a flat position. FIGS. 18 and 19 provide other prospectives for the neck rest. The neck rest 1200 is made of four layers, a fabric layer 1901, a rigid material 1902, a cushion material 1903, and a second fabric layer 1904. The rigid material 1902 could be hard plastic, cardboard, polyethylene, heavy fabric, fiberglass, wood, Medium-density fiberboard (MDF), metal, glass, Ethylene-vinyl acetate (EVA), polyethylene-vinyl acetate (PEVA), nylon filled plastic, Styrofoam, rubber, silicon, Thermoplastic Polyolefins (TPE-O or TPO), beans, Polystyrene, Styrofoam balls, or similar materials. In some embodiments, the rigid material 1902 is divided into 4 sections (and two tabs). While in some embodiments, all of the rigid materials 1902 are the same material, in other embodiments, the rigid materials 1902 could be different in different sections.

The cushion material 1903 could be fabric, latex rubber foam, polyurethane foam, memory foam, polyurethane foam, viscoelastic polyurethane foam, low-resilience polyurethane foam (LRPu), cooling gel foam, reflex foam, convoluted foam, Evlon foam, dryfast foam, wool, cotton, hair, feathers, polyester staple fiber, non-woven material, or paper. The cushion material 1903 is placed next to the rigid material 1902 and is held in place by the fabric.

All of the sections 1902, 1903 are enclosed in between two pieces of a fabric material 101, 1901, 1904 such as velveteen, felt, brushed polyester, cotton, nylon, viscose, polyester nylon blend, rayon, wool, terrycloth, or similar materials. In another embodiment, the sections 1902, 1903 could be enclosed in single piece of fabric 1901, 1904 folded in half. The two pieces of fabric material 101, 1901, 1904 could be connected by sewing, staples, adhesive, heat welding, sonic welding, or similar techniques. The fabric material 101, 1901, 1904 extends beyond the geometric shapes by approximately 0.5 cm in each direction. The extended fabric is used for adhering the two pieces of fabric together. The thickness of the fabric 101, 1901, 1904 and rigid material 1902 can vary, but in one embodiment is approximately 0.4 cm. In another embodiment, the fabric material 101, 1901, 1904 is created around the geometric shapes using a thermoform process that creates a 3-D shape and structure. In still a further embodiment, a 3-D printer with multiple heads is used to create the geometric shapes of a ridged material inside of a more flexible material. In some embodiments, the fabric on the side without the foam is brushed fabric, the loop side of a hook and loop (Velcro) attachment.

The fabric 101, 1901, 1904 is coated with a non-slip coating in some embodiments. This non-slip coating could be a clear silicon, thermoplastic elastomers (TPE), thermoplastic polyurethane (TPU), polyurethane (PU), or foam grip surface. This non-slip coating could be painted-on, stuck-on, or heat applied.

Figure 17:
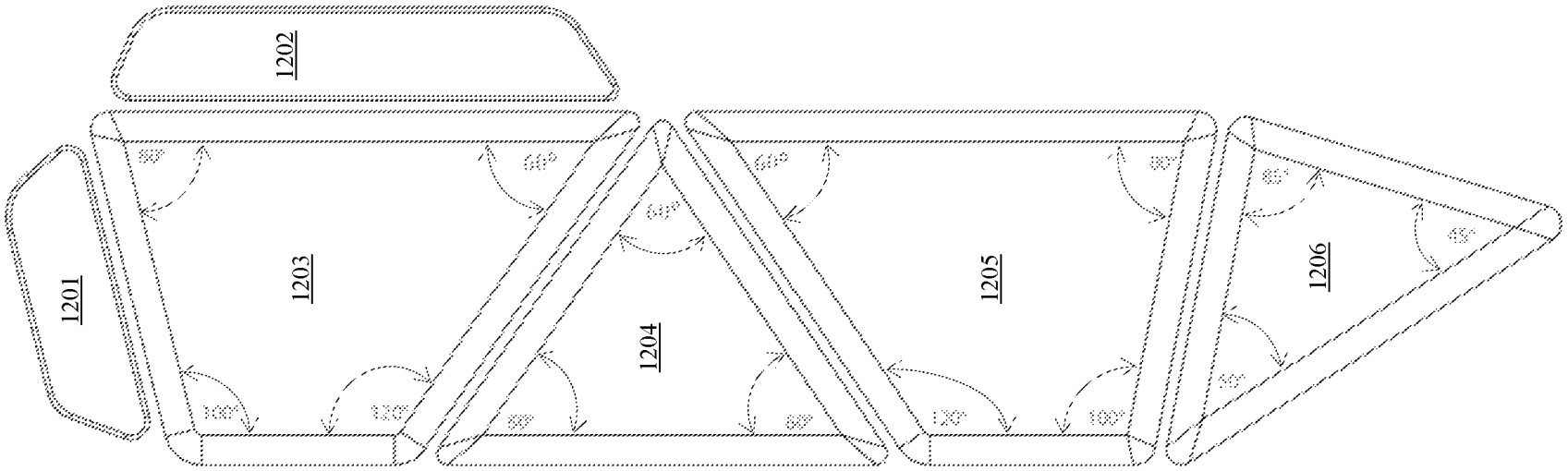
FIG. 17 shows the shapes and the angles of the neck rest in the second embodiment.

FIG. 17 shows the shapes and the angles of the neck rest 1200. Without detracting from the invention, the angles in this drawing have a tolerance of ±10 degrees. In the descriptions below, the hook and loop patches could be swapped without detracting from the invention. FIG. 12 and FIG. 17 are described together.

The neck rest 1200 is 10 cm by 43 cm in size in one embodiment, but the dimensions can be proportionally changed without detracting from the inventions described herein. It is envisioned that there will be different sizes for different people.

The neck rest 1200, at one side, has a trapezoidal shape 1203 of rigid material. The first trapezoid 1203 has a short length of 6.5 cm and a long length of 15 cm. The angles are 120 degrees along the short length by the first triangle 1204 and 100 degrees at the other side. The long length has a 60 degree angle by the first triangle 1204 and a 80 degree angle on the opposite end. The width of the first trapezoid is about 11 cm.

The first trapezoid 1203 has a 6 cm by 3 cm tab 1201 of rigid material enclosed with fabric attached to the side opposite the first triangle 1204. Hook material from a hook and loop material 1905 (for instance Velcro) is attached to the top side of the tab 1201. A second tab 1202, similarly constructed with a rigid interior inside of fabric and including hook material on the top side, is attached to the long side of the first trapezoid 1203. When folded, the hook material on the second tab 1202 attaches to the loop material on the second trapezoid 1205. The hook material on the first tab 1201 attaches to the loop material on the second triangle 1206.

Adjacent to the first trapezoid 1203 is an equilateral triangle 1204 (the first triangle) of rigid material with three 60 degree angles. Given the tolerances, this could be an isosceles triangle. The first triangle 1204 has a width of 7 cm and a base of 12 cm.

Next to the first triangle 1204 is a second trapezoid 1205 of rigid material. This second trapezoid 1205 has a short base of about 6.5 cm and a long top of about 15 cm. The second trapezoid is about 11 cm wide. The short base has an angle of 120 degrees on the side by the first triangle 1204 and an angle of 10 degrees on the other side. The long top has an angle of 60 degrees on the side by the first triangle 1204 and 80 degrees on the other side.

Adjacent to the second trapezoid 1205 is an isosceles (second) triangle 1206 of rigid material. The second triangle 1206 has a 10 cm length on the top and a 13 cm length on the bottom. The side along the second trapezoid 1205 is about 10 cm wide. The angle at the bottom is 50 degrees and at the top left the angle is 85 degrees. The distant angle is 45 degrees.

FIG. 13 through FIG. 16 show the folding of the flat neck rest 1200 into shape for supporting the head. Note that the order of the folding is not important, and that the neck rest 1200 could be formed by folding numerous different orders.

Figure 13:
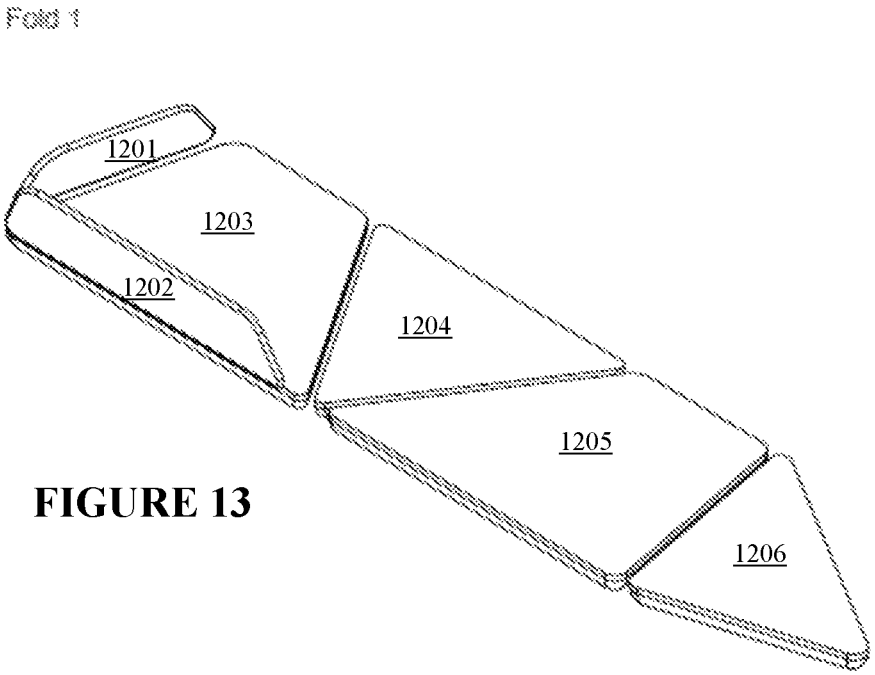
FIG. 13 shows the neck rest of the second embodiment after the first fold.

FIG. 13 shows the first fold, with the cushion side of the neck rest down, folding the tabs 1201, 1202 upwards at the fold between the tabs 1201, 1202 and the first polygon 1203.

Figure 14:
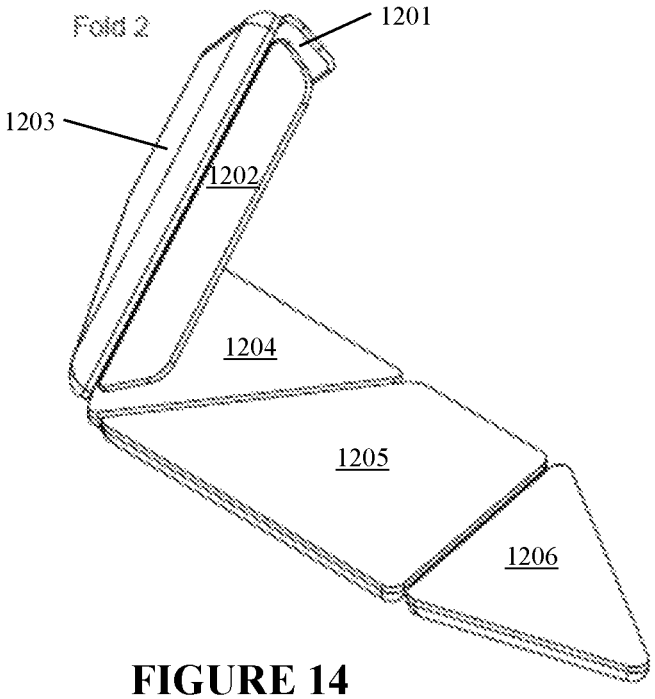
FIG. 14 shows the neck rest of the second embodiment after the second fold.

FIG. 14 shows the second fold, moving the first polygon 1203 upwards at the fold between the first polygon 1203 and the first triangle 1204.

Figure 15:
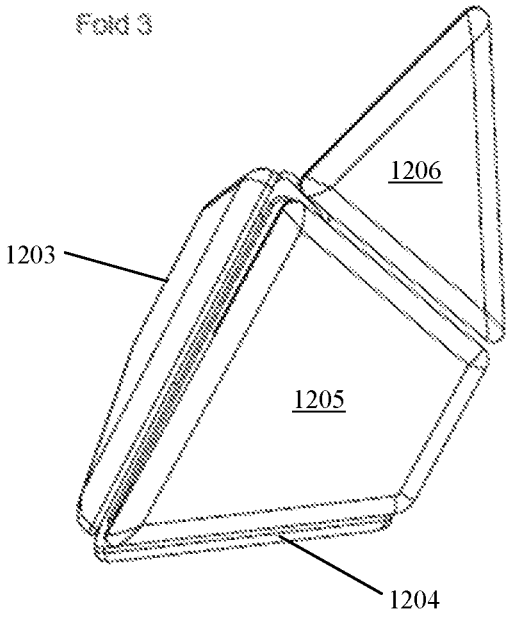
FIG. 15 shows the neck rest of the second embodiment after the third fold.

FIG. 15 shows the third fold, moving the first triangle 1204 upwards at the fold between the first triangle 1204 and the second polygon 1205. The hook portion of the tab 1202 meets and adheres to the loop fabric on the second polygon 1205.

Figure 16:
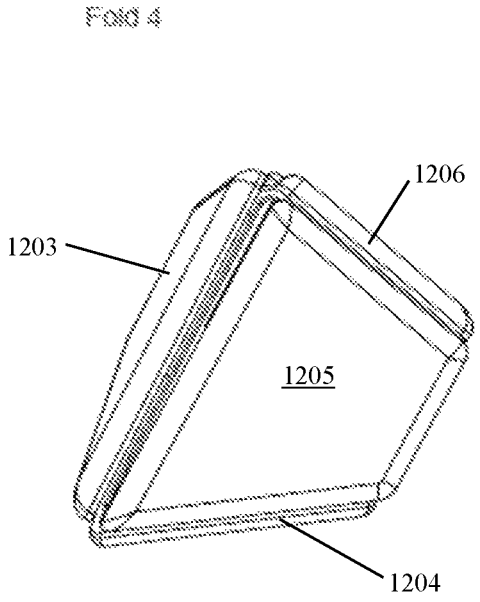
FIG. 16 shows the neck rest of the second embodiment after the forth fold.

FIG. 16 shows the fourth fold, moving the second triangle 1206 backwards at the fold between the second polygon 1205 and the second triangle 1206. The hook portion of tab 1201 meets and adheres to the loop fabric on the back side of second triangle 1206. This is the fully folded neck rest 1200 ready for use.

When unfolded in its flat state, the neck rest 1200 can be folded into a 18 cm by 14 cm by 3 cm thick shape for easy storage in a folio or a laptop bag. The second polygon 1205 is moved backwards at the fold between the first triangle 1204 and the second polygon 106 until the second polygon 1205 flat against the first triangle 1204.

The foregoing devices and operations, including their implementation, will be familiar to, and understood by, those having ordinary skill in the art. All sizes used in this description could be scaled up or down without impacting the scope of these inventions. All angles have a tolerance of ±10 degrees.

The above description of the embodiments, alternative embodiments, and specific examples, are given by way of illustration and should not be viewed as limiting. Further, many changes and modifications within the scope of the present embodiments may be made without departing from the spirit thereof, and the present invention includes such changes and modifications.

The invention claimed is:

1. An apparatus for supporting a head of a user, the apparatus comprising:

a first piece of fabric, wherein at least a portion of the first piece of fabric contains loop material;

a plurality of flat, rigid geometric shapes located on the first piece of fabric;

a plurality of cushion shapes of located on the plurality of geometric shapes;

a second piece of fabric, located on top of the plurality of geometric shapes and the plurality of cushion shapes;

wherein the plurality of geometric shapes consecutively comprise a first trapezoid, a first triangle, a second trapezoid, and a second triangle, with a first tab located on one side of the first trapezoid and a second tab located on an adjacent side of the first trapezoid; wherein the first piece of fabric and the second piece of fabric are sized to cover the geometric shapes and an area for the first tab and the second tab, and wherein hook material is located on the second piece of fabric above the first tab and the second tab;

adhesive located between the first piece of fabric and the second piece of fabric at edges of the first and second pieces of fabric and in between the plurality of geometric shapes, such that the first and second pieces of fabric are held together by the adhesive, and the first and second pieces of fabric holds the plurality of geometric shapes in place;

wherein the plurality of geometric shapes are located such that when the first and second pieces of fabric are folded the hook material and loop material hold the plurality of geometric shapes into a hollow three dimensional rigid structure for supporting the head of the user.

2. The apparatus of claim 1 wherein there are four geometric shapes.

3. The apparatus of claim 1 wherein the adhesive is a chemical adhesive.

4. The apparatus of claim 1 wherein the adhesive is thread.

5. The apparatus of claim 1 wherein the first and second pieces of fabric are brushed nylon.

6. The apparatus of claim 1 wherein the first and second pieces of fabric are velveteen.

7. The apparatus of claim 1 wherein the plurality of cushion shapes are polyurethane foam.

8. The apparatus of claim 1 wherein the plurality of geometric shapes are Ethylene-vinyl acetate (EVA).

9. The apparatus of claim 1 wherein the first and second pieces of fabric are partially coated with a non-slip material.

10. A method of creating a support for a head of a user, the method comprising:

folding a flat structure with a plurality of geometric shapes and cushion material adhered between two pieces of fabric with a first pair of folds such that a first tab and a second tab are folded in front of a first geometric shape;

folding the flat structure with a second and third fold, moving the first geometric shape and a second geometric shape in front the flat structure, such that the second tab is attached to a third geometric shape;

folding the flat structure with a fourth fold such that the first tab is in attached to a fourth geometric shape.

11. The method of claim 10 wherein the first geometric shape is a trapezoid.

12. The method of claim 10 wherein the second geometric shape is a triangle.

13. The method of claim 10 wherein the third geometric shape is a trapezoid.

14. The method of claim 10 wherein the fourth geometric shape is a triangle.

15. The method of claim 10 further comprising adhering the second tab to the third geometric shape with a hook and loop mechanism.

16. The method of claim 10 further comprising adhering the first tab to the fourth geometric shape with a hook and loop mechanism.

17. The method of claim 10 wherein the cushion material is polyurethane form.

18. The method of claim 10 wherein the geometric shapes are Ethylene-vinyl acetate (EVA).

19. The method of claim 10 wherein the two pieces of fabric are partially coated with a non-slip material.

20. The method of claim 19 wherein the non-slip material is a silicon coating.

* * * * *